US009021848B2

(12) United States Patent
Leacock et al.

(10) Patent No.: US 9,021,848 B2
(45) Date of Patent: May 5, 2015

(54) METHOD FOR FORMING A SECTOR FOR A NACELLE LIP SKIN

(75) Inventors: Alan Leacock, Carrickfergus (GB); Michael Ludlow, Belfast (GB); Desmond Brown, Newtownabbey (GB); Robert Joseph McMurray, Ballygowan (GB)

(73) Assignee: University of Ulster (GB)

( * ) Notice: Subject to any disclaimer, the term of this patent is extended or adjusted under 35 U.S.C. 154(b) by 1152 days.

(21) Appl. No.: 13/003,113

(22) PCT Filed: Jun. 19, 2009

(86) PCT No.: PCT/EP2009/004434

§ 371 (c)(1), (2), (4) Date: Feb. 17, 2011

(87) PCT Pub. No.: WO2010/003538

PCT Pub. Date: Jan. 14, 2010

(65) Prior Publication Data

US 2011/0162429 A1 Jul. 7, 2011

(30) Foreign Application Priority Data

Jul. 10, 2008 (GB) ..... 0812614.6

(51) Int. Cl.

*B21D 53/92* (2006.01)
*B21D 25/02* (2006.01)
*B21D 25/04* (2006.01)

(52) U.S. Cl.

CPC ..... *B21D 53/92* (2013.01); *B21D 25/02* (2013.01); *B21D 25/04* (2013.01)

(58) Field of Classification Search

CPC ..... B21D 5/01; B21D 5/04; B21D 25/02; B21D 25/04; B21D 19/12; B21D 53/92

USPC ..... 72/293, 295, 296, 308, 311, 316, 318, 72/319, 320, 321, 322, 323, 372, 375, 377, 72/379.2, 379.6, 422

See application file for complete search history.

(56) References Cited

U.S. PATENT DOCUMENTS 2,242,204 A * 5/1941 Kennedy ..... 72/215
2,676,638 A * 4/1954 Wheeler et al. ..... 72/296

(Continued)

FOREIGN PATENT DOCUMENTS

DE 10334483 3/2005
JP 2002282953 10/2002

OTHER PUBLICATIONS

PCT Search Report for PCT Application No. PCT/EP2009/004434.

*Primary Examiner* — Shelley Self
*Assistant Examiner* — Pradeep C Battula
(74) *Attorney, Agent, or Firm* — Gardner, Linn, Burkhart & Flory, LLP

(57) ABSTRACT

Forming a sector for a nacelle lip skin from a sheet metal blank via punch by placing the blank against an outer surface of the punch and clamping a trailing edge of the blank in a clamping member that grips a trailing edge of the blank without slippage; gripping a leading edge of the blank, opposite the trailing edge, in a gripping device at a location axially spaced from the punch with sufficient force to permit the blank to flow therethrough in a controlled manner; displacing the gripping device in a first direction, radially with respect to the punch while drawing the blank through the gripper; displacing the gripping device in a second direction, axially with respect to the punch, to draw the blank over the leading edge of the punch and through the gripping device.

15 Claims, 9 Drawing Sheets

(56) References Cited

U.S. PATENT DOCUMENTS

| | | | | |
|---|---|---|---|---|
| 2,678,638 | A * | 5/1954 | Bopp | 91/24 |
| 5,035,133 | A * | 7/1991 | White et al. | 72/296 |
| 5,615,571 | A * | 4/1997 | Courant | 72/322 |
| 5,735,160 | A * | 4/1998 | VanSumeren et al. | 72/296 |
| 5,737,953 | A * | 4/1998 | Allison et al. | 72/58 |
| 6,675,624 | B2 | 1/2004 | Naaktgeboren et al. | |
| 7,334,447 | B1 * | 2/2008 | Kulkarni et al. | 72/379.2 |
| 7,654,124 | B2 * | 2/2010 | Knaup | 72/296 |
| 2002/0062675 | A1 * | 5/2002 | Naaktgeboren et al. | 72/296 |
| 2004/0226333 | A1 * | 11/2004 | Kato et al. | 72/68 |

* cited by examiner

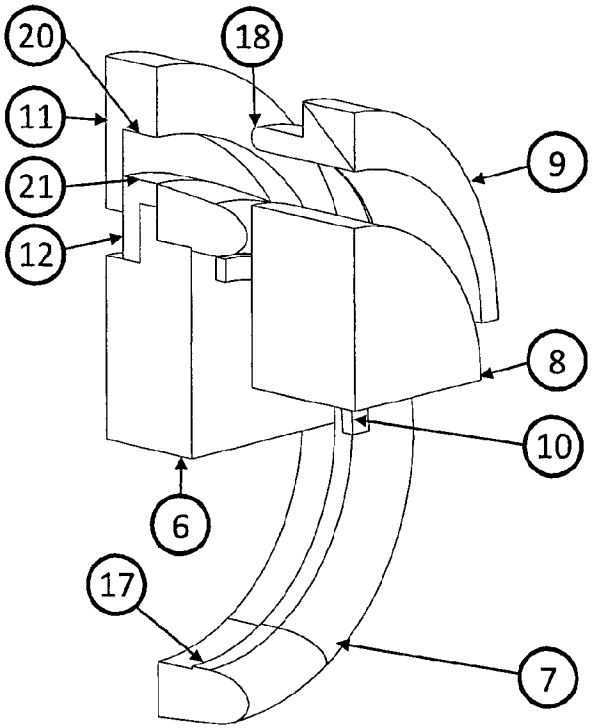
Figure 2:B
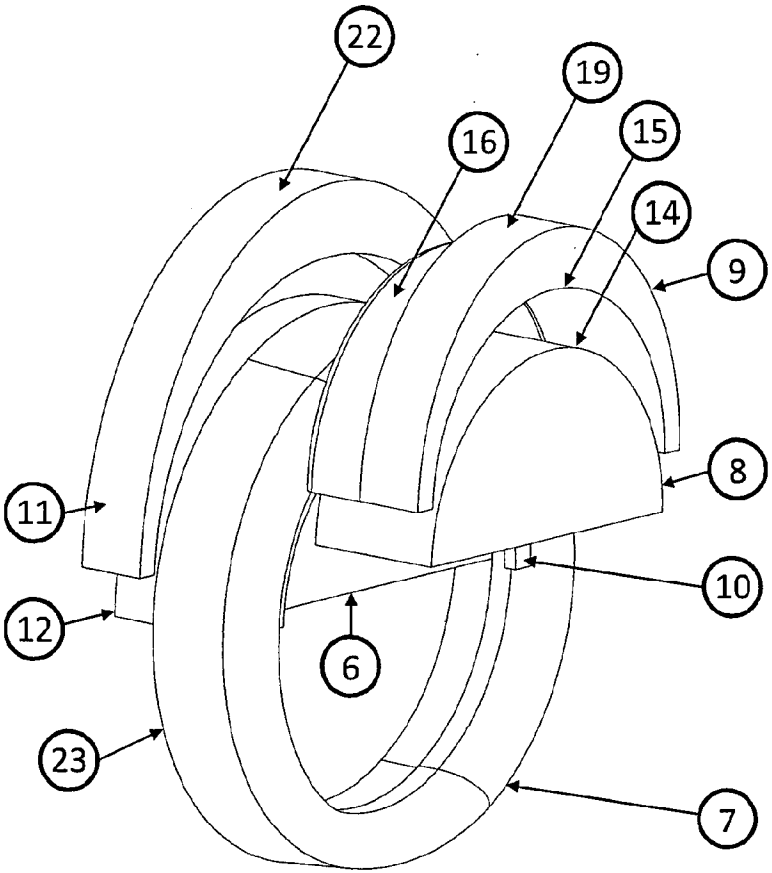
Figure 2:A

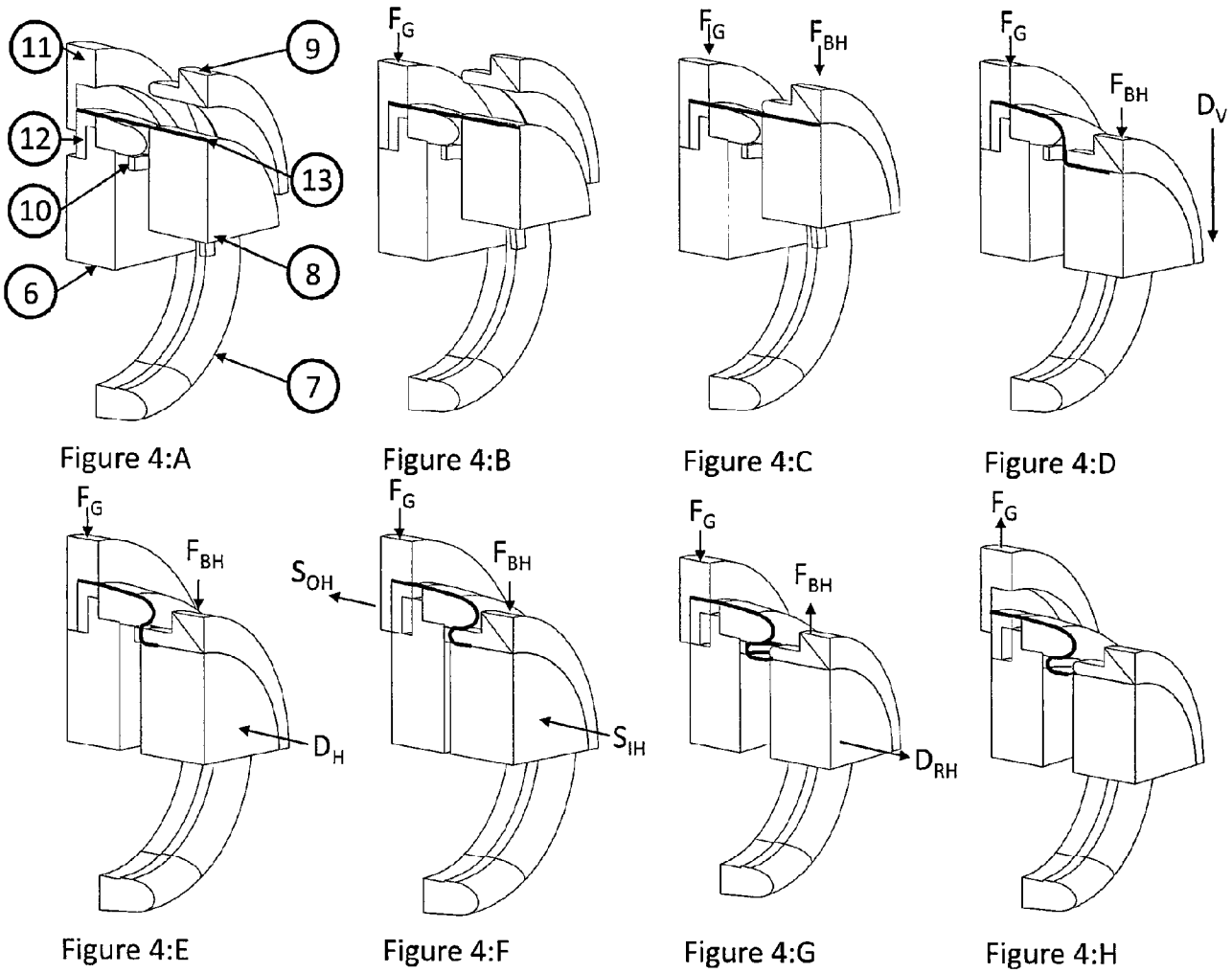
Figure 4:A
Figure 4:B
Figure 4:C
Figure 4:D
Figure 4:E
Figure 4:F
Figure 4:G
Figure 4:H

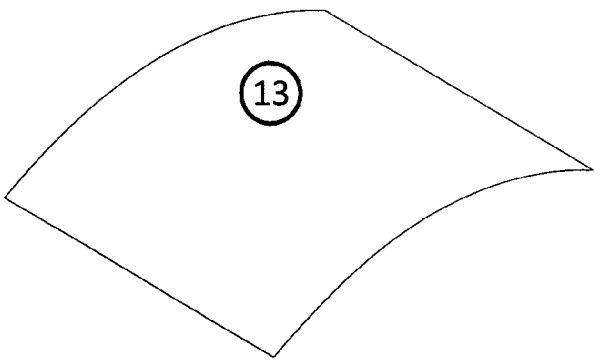
Figure 5:A
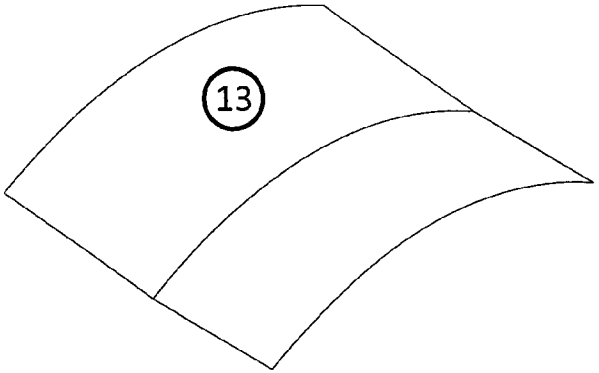
Figure 5:B
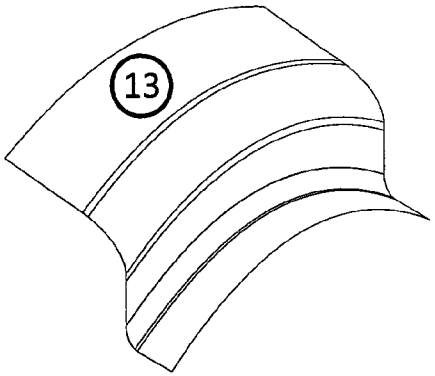
Figure 5:C
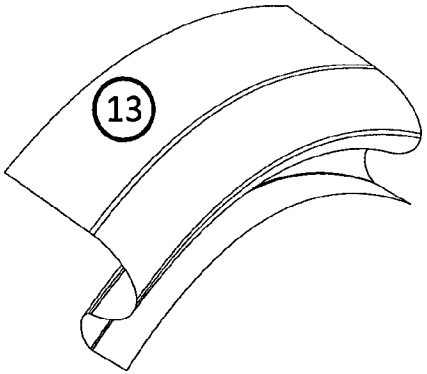
Figure 5:D

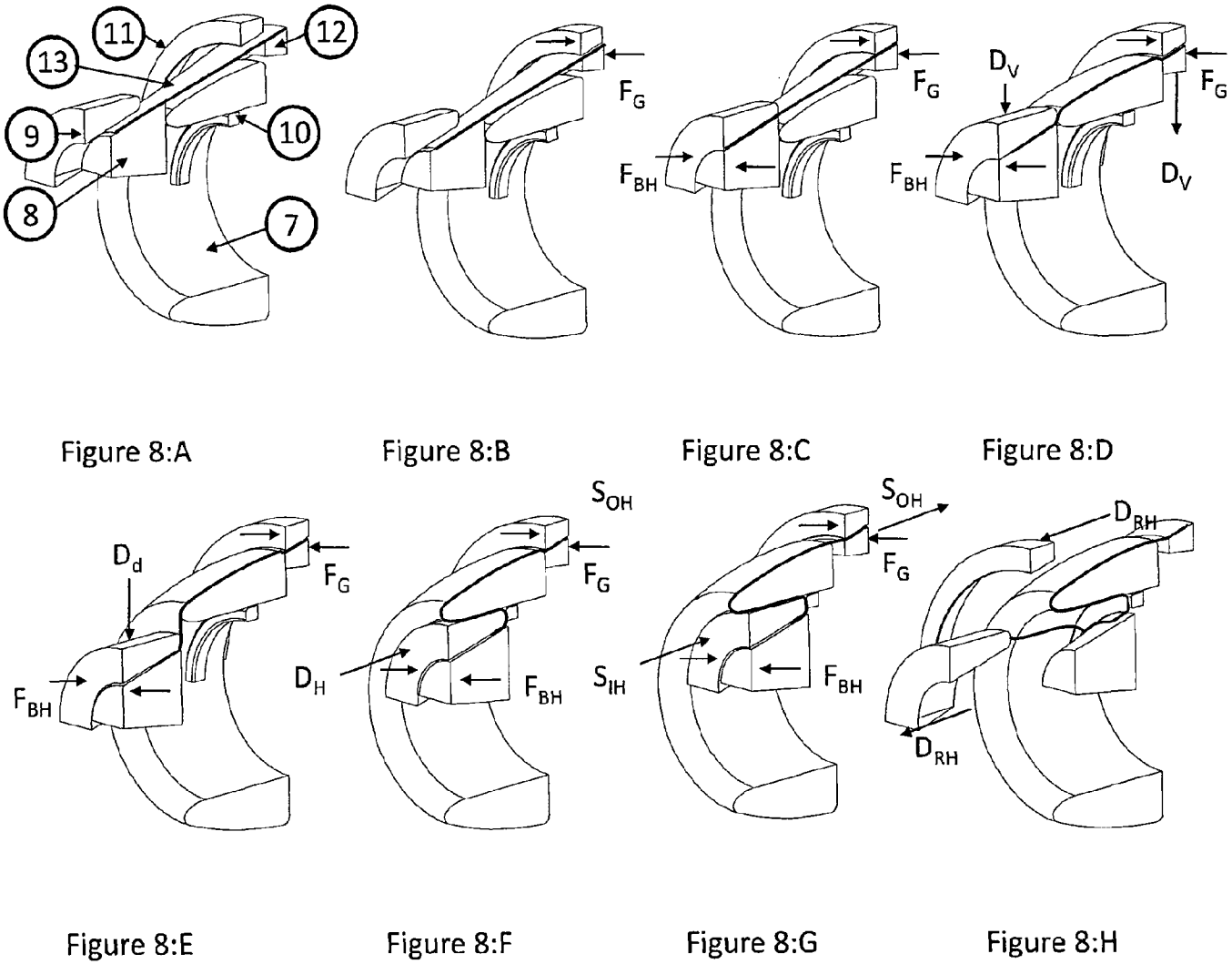
Figure 8:A
Figure 8:B
Figure 8:C
Figure 8:D
Figure 8:E
Figure 8:F
Figure 8:G
Figure 8:H

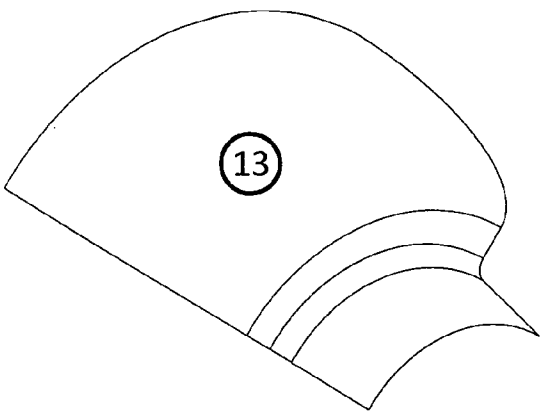
Figure 9:B
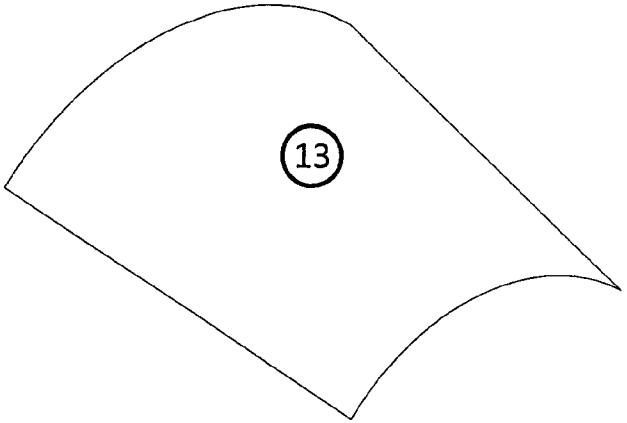
Figure 9:A
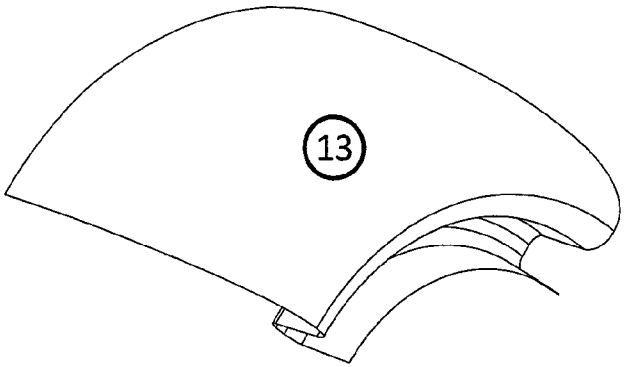
Figure 9:C

METHOD FOR FORMING A SECTOR FOR A NACELLE LIP SKIN

This invention relates to method and apparatus for forming compound curvature metal skins and in particular to a method and apparatus for forming a nacelle cowl leading edge (hereinafter referred to as a "lip skin") or a sector thereof from a single metal blank.

A typical nacelle lip skin is illustrated in FIG. 1. The nacelle comprises a thin, aerodynamically shaped metal skin covering a jet engine of an aircraft. The front region of the nacelle comprises a lip skin defining the inlet of the engine, which may be comprised of a single piece or multiple sectors. The main features of the lip skin are a smooth outer trailing edge 1, which must be free from irregularities and discontinuities to reduce drag and to avoid the creation of turbulence and an inner inlet edge 2, which is typically shaped to attenuate noise from the engine by shielding fan noise and to guide the flow of air into the engine, and a leading edge or lip 3, which provides a smooth transition between the outer trailing edge and the inner inlet edge while creating a small frontal area to reduce drag. The lip skin, and in particular the leading edge 3 thereof, is prone to damage from debris kicked up during take off and landing and by bird strike. If the lip skin of the nacelle is damaged, the damaged section must be replaced. Typically this necessitates cutting out the damaged section and cutting a corresponding section 4 from a replacement lip skin, or alternatively replacement of the entire nacelle lip skin.

While composite materials can be used for many parts of the nacelle, the lip skin must generally be made from a metal, such as aluminium or titanium, to be able to withstand impacts upon the leading edge or lip thereof. However, the complex three dimensional compound curvature shape of the lip skin, having compound curvatures, typically requires a complex multi-stage forming process, often requiring intermediate heat treatments. Typically lip skins are produced by multiple stage deep drawings or spin forming processes, requiring complex and costly tooling and time consuming multi-step processing with intermediate heat treatments. Furthermore, such known processes are generally only suitable for forming complete annular lip skins and thus cannot readily be used to produce separate sectors required to repair specific damaged sectors of a nacelle lip skin.

Moreover, due to aerodynamic and noise considerations, it is particularly desirable to extend the outer trailing edge of the lip skin as far as possible, known as laminar flow leading edges wherein the axial length of the outer trailing edge of the lip skin can be much greater than axial length of the inner inlet edge. Known deep drawing processes are unsuitable for the manufacture of such laminar flow leading edges.

According to a first aspect of the present invention there is provided a method of forming a sector of a nacelle lip skin from a sheet metal blank comprising the steps of:

providing an arcuate or annular punch or mandrel having an inner surface, an outer surface and a leading edge, said punch substantially corresponding in shape to an inner surface of at least a sector of the nacelle lip skin;

placing the blank against the outer surface of the punch and clamping a trailing edge of the blank in a clamping means to hold the blank against the outer surface of the punch, said clamping means gripping said trailing edge of the blank without slippage;

gripping a leading edge of the blank, opposite said trailing edge, in a gripping means, at a location axially spaced from said punch adjacent and in front of the leading edge of the punch, said gripping means gripping said blank with sufficient force to permit the blank to flow therethrough in a controlled manner without tearing or wrinkling;

displacing the gripping means in a first direction, substantially radially with respect to the punch towards the central axis of the punch while drawing the blank through the gripping means;

displacing the gripping means in a second direction, substantially axially with respect to the punch, towards and past the leading edge of the punch, to draw the blank over the leading edge of the punch while drawing the blank through the gripping means.

Preferably the method comprises the further step of further displacing the gripping means in said second direction while preventing the blank from being drawn through said gripping means to stretch the blank over the surface of the punch. Preferably said further step further comprises axially displacing said clamping means relative to the punch in said second direction to further stretch the blank over the surface of the punch. Preferably the blank is prevented from being drawn through the gripping means by abutting a leading edge of the gripping means against a gripping member having an axial gripping face adapted to cooperate with a leading edge the gripping means to clamp the blank therebetween.

According to a further aspect of the present invention there is provided a method of forming a lip skin of a nacelle from a metal blank comprising forming the blank into a curved shaped having a radius corresponding to the radius of the outer surface of a punch and clamping one side of the blank at or adjacent said outer surface, clamping an opposite curved side of the blank in a gripping means comprising first and second gripping members located adjacent and in front of a leading edge of the punch, said first and second gripping members holding said blank with sufficient force to permit the blank to flow in a controlled manner between the gripping members without tearing or wrinkling, moving the gripping means in a first direction, substantially radially inwardly with respect to the axis of the punch, to draw the blank over the leading edge of the punch, subsequently moving the gripping means in a second direction, transverse to said first direction and substantially axially with respect to the axis of the punch, to draw the blank around the leading edge of the punch. Preferably the method comprises the further step of preventing flow of the blank between the first and second gripping members of the gripping means during further movement of the gripping means in said second direction to stretch the blank over the surface of the punch.

According to a further aspect of the present invention there is provided an apparatus for forming a sector of a lip skin comprising:

an arcuate or annular punch or mandrel having an outer surface, an inner surface and a leading edge, said punch corresponding in shape to at least a sector of the inner surface of the nacelle lip skin to be formed;

clamping means for clamping a trailing edge of a blank to hold the blank against or adjacent the outer surface of the punch, said first clamping means being arranged to hold said trailing edge of the blank without slippage;

gripping means for gripping a leading edge of the blank, opposite said trailing edge, at a location axially spaced from said punch adjacent and in front of the leading edge of the punch, said gripping means being arranged to grip said blank with sufficient force to permit the blank to flow therethrough in a controlled manner without tearing or wrinkling;

said gripping means being displaceable with respect to the punch in a first direction, substantially radially with respect to the punch towards the central axis of the punch, and in a second direction, substantially axially with respect to the punch towards and past the leading edge of the punch to draw the blank over the leading edge of the punch.

The punch may comprise an annular body, replicating an entire nacelle lip skin.

Alternatively the punch may comprise an arcuate sector corresponding to a sector of the lip skin to be formed. Where the punch comprises an annular body, the punch may be non-axisymmetric to enable the formation of a sector of an non-axisymmetric lip skin. The punch may be rotatable with respect to the gripping means and the clamping means to enable the punch to be indexed with respect to the gripping means and clamping means to the correct position corresponding to the sector of the lip skin to be formed.

Embodiments of the present invention will now be described, by way of example only, with reference to the accompanying drawings, in which:

FIG. 2A is a perspective view of a tool for forming a lip skin in accordance with a first embodiment of the present invention;

FIG. 2B is a sectional view of the tool of FIG. 2A;

FIGS. 4A to 4H illustrate the use of the tool of FIG. 2A in a method of forming a nacelle lip skin in accordance with a first embodiment the present invention;

FIGS. 5A to 5D illustrate the initial, intermediate and final shapes of the blank during a forming operation;

FIGS. 8A to 8H illustrate the use of the tool of FIG. 6 in a method of forming a nacelle lip skin in accordance with a second embodiment of the present invention; and FIGS. 9A to 9C illustrate the initial, intermediate and final shapes of the blank during a forming operation.

The present invention provides a method and apparatus for forming a sector of a nacelle lip skin which overcomes the disadvantages of the prior art and is of particular benefit for nacelle repairs by facilitating the quick and easy creation of a replacement sector of a lip skin to replace a damaged sector. While the present invention is particularly described in relation to nacelle lip skins for aircraft, the method and apparatus according to the invention can also be used for the manufacture of other standard or laminar flow leading edges for a variety of applications.

Figure 1:
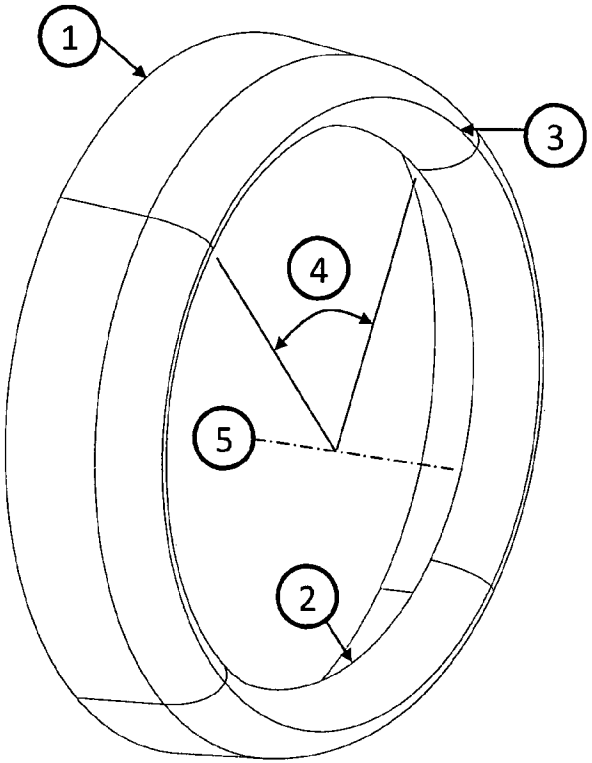
FIG. 1 is a perspective view of a lip skin of a nacelle.
Figure 3:
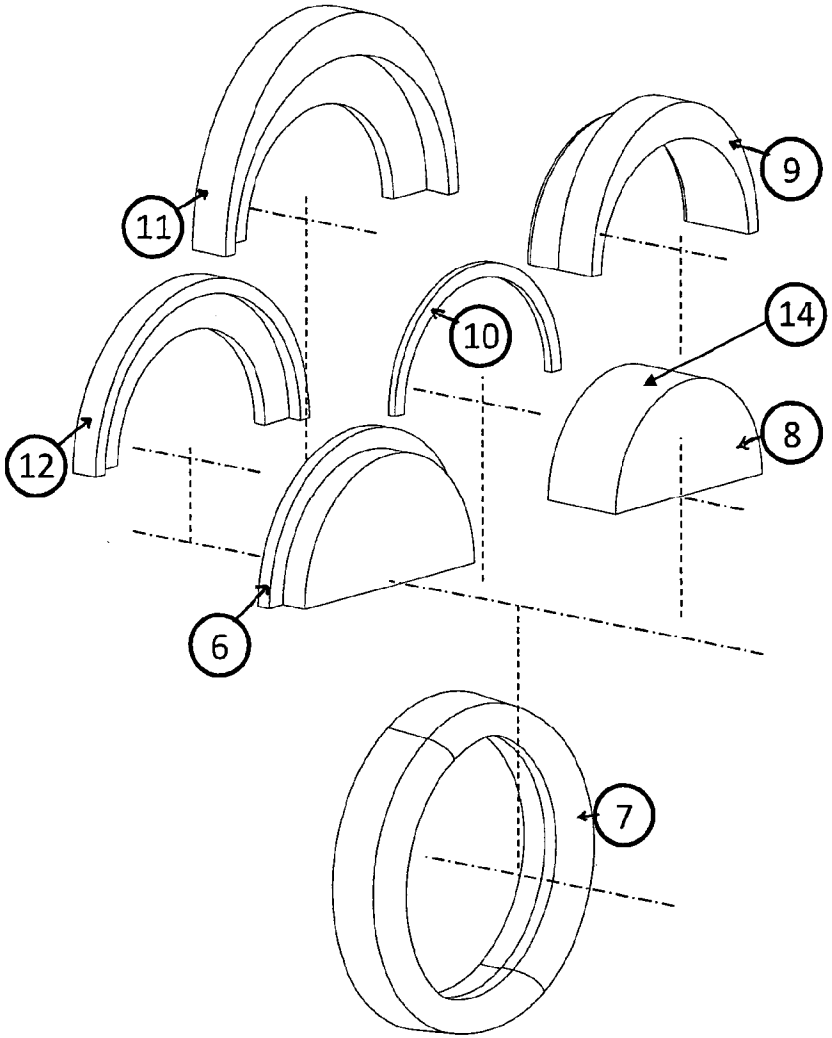
FIG. 3 is an exploded view of the tool of FIG. 2A.
Figure 6:
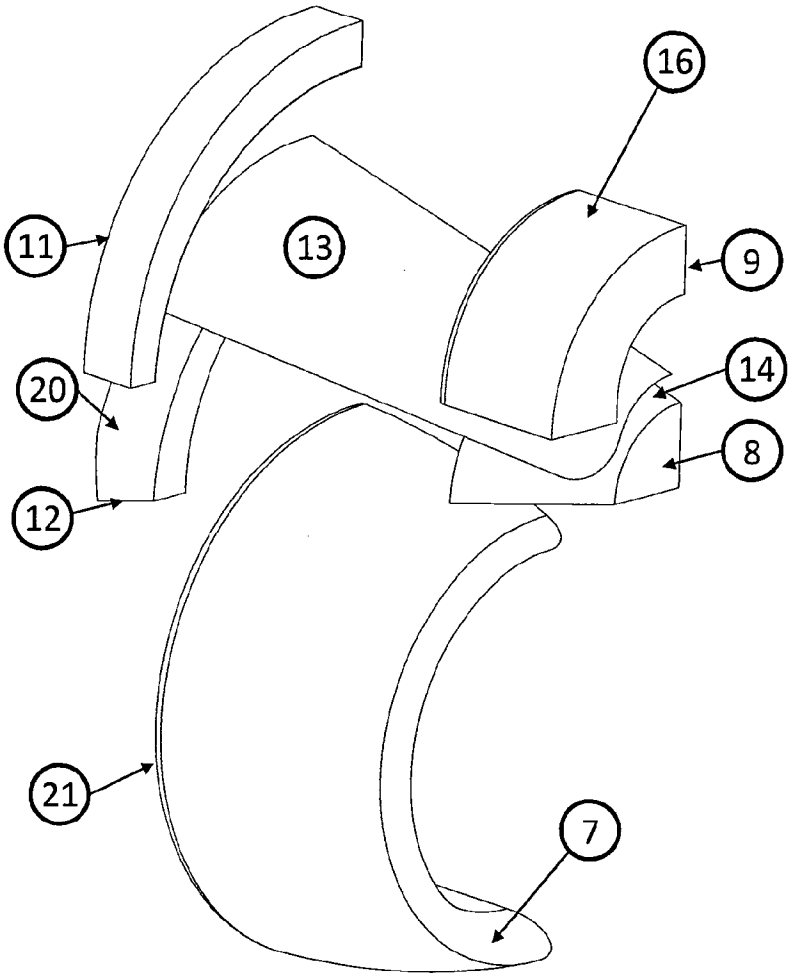
FIG. 6 is a sectional view of a tool for forming a lip skin in accordance with a second embodiment of the present invention.
Figure 7:
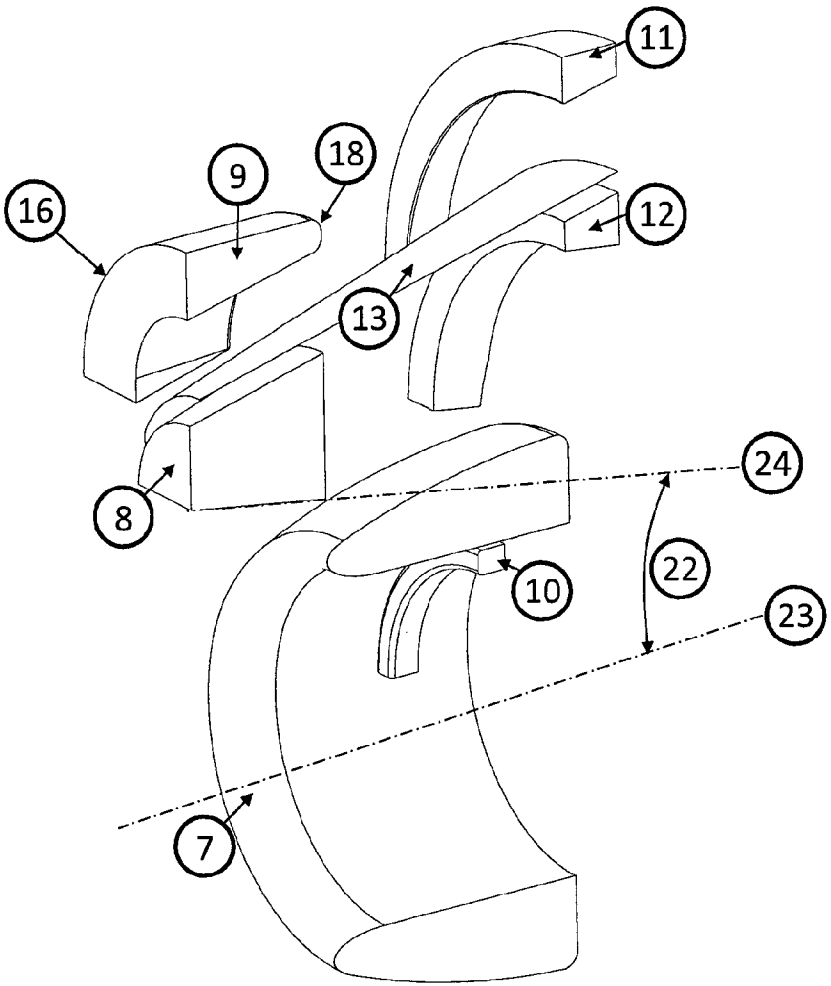
FIG. 7 is a further sectional view of the tool of FIG. 6.

As illustrated in FIGS. 2 to 4, a tool for forming a nacelle lip skin in accordance with a first embodiment of the present invention comprises a tool base 6 for supporting the other components of the tool. An annular punch 7 is supported on an outer edge of the tool base. The tool base 6 may comprise a full 360° disc shaped core having an outer lip for supporting an inner edge of the punch 7 or may comprise a sector, for example a 180° sector supporting just an upper portion of the punch 7.

The annular punch 7 has an outer surface, a leading edge and an inner surface having a shape corresponding to the inner surface of the finished lip skin. The punch 7 may correspond to a sector of the lip skin, for example a 180° sector, or may comprise a full 360° annulus corresponding to the entire lip skin. The punch 7 may be rotated with respect to the tool base 6 to index the punch relative to the rest of the tool so that the region of the punch corresponding to the sector of the lip skin to be produced is used for formation of the sector. This facilitates the formation of sectors of non-axisymmetric lip skins.

An arcuate blank holder 8 is located adjacent to and axially spaced from the tool base 6. The outer surface of the blank holder 8 may be provided with a replaceable wear plate 14 against which the blank 13 is slidable.

An arc die 9 is adapted to cooperate with the blank holder 8 to engage a blank 13 therebetween, as will be described in more detail below. The arc die 9 has an inner surface adapted to fit against an outer surface of the blank holder 8, more specifically the wear plate 14 provided thereon, with a portion of the blank 13 interposed therebetween. The inner surface of the arc die 9 may be provided with a replaceable wear surface 15. A drive mechanism for radially moving the arc die 9 with respect to the blank holder 8 may be housed within the blank holder 8. The drive mechanism may comprise one or more double acting rams. A lubricant dispensing means may be provided for dispensing a lubricant between the blank and the facing surfaces of the blank holder 8 and the arc die 9 to assist drawing of the blank therebetween.

The arc die 9 has a leading edge 18 adjacent to the leading edge of the punch 7 and a stepped outer surface, having a first portion 16 adjacent to the leading edge 18 having an external radius corresponding to the inner radius of the punch 7 such that the first portion 16 of the arc die can telescopically move into the centre of the punch 7, and a thicker second section, distal from said leading edge, to provide sufficient tool stiffness. The shape of the second section may be adapted to provide the required stiffness to obtain an even clamping force across the width of the blank 13. The leading edge 18 of the arc die 9 is filleted to minimise wrinkling and ensure a smooth draw process.

An internal arc grip 10 is mounted on a front face of the tool base 6 to cooperate with the leading edge 18 of the arc die 9 to clamp the blank 13 therebetween in a final stretch forming step, as will be described in more detail below. The surface of the arc grip 10 may be textured or otherwise formed or modified to ensure that the blank 13 can be gripped without slippage.

Clamping members comprised by a transfer arc grip 12 (inner) and a coaxial external arc grip 11 (outer) are mounted adjacent to the punch 7, supported on the rear of the tool base 6, to firmly clamp a side region of the blank 13 therebetween at a trailing edge of the blank 13 to locate the blank 13 against the outer side of the punch 7. The clamping surfaces 20,21 of the external and transfer arc grips 11,12 may be textured or otherwise formed or modified to ensure that the blank 13 is gripped without slippage. The clamping surfaces 20,21 of the external and transfer arc grips may be defined by replaceable wear surfaces. Each of the transfer arc grip 12 and the coaxial external arc grip 11 may extend through an angle sufficient to grip the width of the blank 13 to be formed. The minimum width of the clamping surfaces 20,21 should preferably correspond to the width of the widest sector of lip skin to be formed by the tool. In the embodiment shown, the external and transfer arc grips 11,12, as well as the blank holder 8 and the arc die 9, extend through an angle of 180°. However, this is only illustrated by example and the angular extent of such components may vary.

Adequate stiffness is ensured by the use of a stepped thickness cross section of the external and transfer arc grips 22, 12. The clamping surfaces 20,21 external arc grip 11 and transfer arc grip 12 firmly hold said side region of the blank 13 throughout the forming process. Actuators are provided for radially moving the external arc grip 11 and the transfer arc grip 12 relative to each other and to provide the required clamping force.

In an alternative embodiment, the external arc grip 11 may act directly on a portion of the outer surface of the punch 7 to clamp the blank 13 thereagainst.

A differential drive mechanism is provided between the transfer arc grip 12 and the internal arc grip 10 for controlling displacement of the transfer arc grip away from the tool base 6 as a function of the displacement of the internal arc grip towards the tool base during a final stretch forming step, as will be described below. The differential drive mechanism may comprise a closed fluid filled chamber having different diameter or cross-sectional area pistons slidably mounted therein acting against the transfer arc grip 12 and internal arc grip 10, such displacement of internal arc grip towards the tool base 6 results in a relatively smaller displacement of the transfer arc grip 12 away from the tool base 6. This differential displacement will be important to achieve the desired final stretch process. Alternatively a system of gearing and/or a cam and cam follower arrangement may be provided for transmitting movement between the internal arc grip 10 and the transfer arc grip 12.

For axisymmetric lip skins the radius of the clamping surface 20 of the external arc grip 11 is equal to the radius of the trailing edge of the finished lip skin sector.

For non-axisymmetric lip skins, the radius of the clamping surface 21 of transfer arc grip 12 will be the minimum value of the trailing edge radius of the lip skin. At radial positions where there is a mismatch in radii, suitable blending fillets may be used. For highly non-axisymmetric lip skins, the transfer arc grip 12 may comprise a full 360° annular member corresponding to the annular punch 7 and indexable therewith. In this case, the external arc grip 11 may be formed from a flexible segmented member allowing the external arc grip 11 to conform to the shape of the relevant sector of the transfer arc grip 12.

The overall size of the blank 13 will be determined from the required sector size and the required draw during the forming process. The minimum size of material should be used to ensure near net shape forming. The "flow" of material can be further enhanced using a profiled blank.

In use, a method for forming a sector of a nacelle lip skin using the tool described above is as follows.

Where a 360° non-axisymmetric punch 7 is used to create a sector of a non-axisymmetric lip skin, the punch 7 (and the transfer arc grip 12 if appropriate) is indexed to the correct position corresponding to the sector of the lip skin to be formed.

Firstly, a blank 13 is placed against the outer surface of the punch 7 and in contact with the blank holder 8. Depending upon the thickness, strength and size of the blank 13, it may require a pre-form rolling operation to a curvature having a radius substantially equal to the radius of the outer surface of the punch 7. The blank 13 is positioned with one end of the blank 13 located between the transfer arc grip 12 and the external arc grip 11 and an opposite end of the blank 13 between the blank holder 8 and the arc die 9, as shown in FIG. 4A.

A clamping force $F_G$ is applied between the external arc grip 11 and the transfer arc grip 12 to fully grip the blank 13 therebetween without slippage, as shown in FIG. 4B. The blank shape at this stage is illustrated in FIG. 5A.

A clamping force $F_{BH}$ is next applied between the are die 9 and the blank holder 8 sufficient to permit the blank 13 to flow in a controlled manner between the blank holder 8 and the arc die 9 without tearing or wrinkling, as shown in FIG. 4C. The blank holder 8 remains stationary with respect to the tool base 6 and punch 7 during this stage. The blank shape at this stage is illustrated in FIG. 5B.

Next the blank holder 8 and the arc die 9 are displaced downwardly in a radial direction towards the axis of the punch 7 by a distance $D_V$, while maintaining said controlled clamping force $F_{BH}$ between the arc die 9 and the blank holder 8, as shown in FIG. 4D.

During this stage, the blank 13 flows, in a regulated manner between the blank holder 8 and the arc die 9 and is shaped over the leading edge of the punch 7 to create the blank shape illustrated in FIG. 5C.

Next the blank holder 8 and the arc die 9 are displaced horizontally, by a distance $D_H$, towards and past the leading edge of the punch 7 while maintaining said controlled clamping force $F_{BH}$ between the arc die 9 and the blank holder 8, as shown in FIG. 4E. During this stage the blank 13 flows, in a regulated manner from between the tool holder 8 and the arc die 9 while reverse drawing around the leading edge 18 of the arc die 9. The blank shape at this stage is illustrated in FIG. 5D. Such motion may be obtained by moving the punch 7 with respect to the blank holder 8.

At this point the leading edge 18 of the arc die 9, with the blank 13 disposed thereon, abuts the internal arc grip 10 to grip the blank 13 therebetween. Continued motion by a distance $S_{IH}$ of the blank holder 8 and arc die 9 with respect to the tool base 6/punch 7 stretches the blank 13 over the surface of the punch 7.

At this stage the action of the arc die 9 against the internal arc grip 10 is transmitted through the differential drive mechanism to cause the transfer arc grip 12 and the external arc grip 11 to be displaced with respect to the tool base 6/punch 7 by a distance $S_{OH}$ while maintaining the gripping force $F_G$, as shown in FIG. 4F. The ratio of $S_{IH}$ to $S_{OH}$, determined by the differential drive mechanism, is critical to the final stretch operation to achieve the required final form without creases, tears or wrinkling and minimal springback.

Once the final form has been achieved, the clamping force $F_{BH}$ between the tool holder 8 and the arc die 9 is released and the blank holder 8 and arc die 9 are retracted, as shown in FIG. 4G. Next the clamping force $F_G$ between the transfer arc grip 12 and the external arc grip 11 is released and the external arc grip 11 is retracted away from the transfer arc grip 12 to release the formed part, as shown in FIG. 4H.

The final lip skin can be produced by cutting away the parts of the blank 13 held by the external arc grip 11 and internal arc grip 10 so that the final product is devoid of tool marks.

Due to the tapered shape of the lip skin, it has been found that the shaping of an arcuate blank over the die can result in wrinkling of the metal, particularly with certain metals. Furthermore, variations in the thickness of the blank can cause problems in relation to the action of the clamping and gripping means. A second embodiment of the present invention (illustrated in FIGS. 6 to 9C) alleviates these problems by utilising a conical blank 13 and profiling the blank holder 8 and arc die 9 and the external and transfer arc grips 10,11 to define conical gripping surfaces holding the blank substantially parallel to a line extending from a trailing edge of the punch 7 (substantially corresponding to a trailing edge of the finished lip skin) to a leading edge of the front of the punch 7 (i.e. the apex of the leading edge of the lip skin). In the drawings, like reference numerals are used to describe like parts between the two embodiments.

The apparatus according to the second embodiment of the invention is similar to the first embodiment in many details, comprising an annular punch 7 supported on a tool base (not shown).

As with the first embodiment, the annular punch 7 has an outer surface, a leading edge and an inner surface having a shape corresponding to the inner surface of the finished lip skin. Again, the punch 7 may correspond to a sector of the lip skin, for example a 180° sector, or may comprise a full 360° annulus corresponding to the entire lip skin. The punch 7 may be rotated with respect to the tool base (not shown) to index the punch relative to the rest of the tool so that the region of the punch corresponding to the sector of the lip skin to be produced is used for formation of the sector. This facilitates the formation of sectors of non-axisymmetric lip skins.

A blank holder 8 is located adjacent and axially spaced from the tool base. The outer surface 14 of the blank holder 8 comprising a 180° of a truncated cone having an outer surface shaped to mate with the conical blank. An arc die 9 is provided having an inner surface adapted to cooperate with the outer surface of the blank holder 8 to permit the blank to flow in a controlled manner from between the blank holder 8 and arc die 9 without tearing or wrinkling. The outer radius of the arc die 9 is adapted to allow the arc die 9 to pass inside of the annular punch 7 with sufficient clearance to ensure that the blank does not become trapped between the outer surface of the arc die 9 and the inner surface of the punch 7.

The front face 18 of the arc die 9 is shaped to allow the blank to be drawn over the front face of the arc die 9 to minimise wrinkling and to ensure a smooth draw/redraw process. An actuating mechanism is provided for moving the arc die 9 horizontally with respect to the blank holder 8 to clamp the blank 13 therebetween. The transfer arc grip 12 and external arc grip 11 are provided with conical mating surfaces for gripping a trailing edge of the blank 13. The mating faces of the transfer arc grip 12 and external arc grip 11 are appropriately textured to preclude slippage. Adequate stiffness is ensured by the use of a conical section.

The transfer arc grip 12 and external arc grip 11 clamp the blank 13 adjacent to its trailing edge throughout the forming operation. For axisymmetric lip skins the conical surface 20 of the transfer arc grip 12 is coincident with the trailing edge of the blank 13. For non-axisymmetric lip skins, the conical surface 20 of the transfer arc grip 12 corresponds to the minimum radius of the trailing edge of the punch 7. At radial positions where there is a mismatch in the radii, suitable blending fillets may be used. To accommodate larger variations in radius of the lip skin, the transfer arc grip 12 may be formed as a full 360° surface following the radial variations of the punch 7. In such embodiment, the external arc grip 11 may be formed as a segmented member having sufficient flexibility to conform to the shape of the transfer arc grip 12.

The internal arc grip 10 is arranged with a clamping face adapted to abut the leading edge of the arc die 9 to provide a final stretching process. The internal arc grip 10 is linked to the transfer arc grip 12 by a differential displacement drive, comprising suitable gearing of hydraulic linkages (with differential diameter pistons) in the same manner as the first embodiment, as will de described below.

The blank 13 has a size determined from the required sector size and the required draw during the forming process. The minimum material size is used to ensure near net shape forming. The flow of the material may be enhanced further by using a profiled blank. The conical profile of the blank 13 may be produced during the process or may be formed by an initial pre-forming process, for example by a roll bending operation.

The conical surfaces of the transfer arc grip 12 and external arc grip 11 and of the blank holder 8 and arc die 9 provide a variable pressure clamping effect that can compensate for material thickness variability.

The blank holder 8, arc die 9 and transfer and external arc grip 10,11 are arranged with respect to the punch 7 so that the central axis 23 of the punch 7 is inclined with respect to the central axis 24 of the blank 13 to so that the blank is substantially parallel to a line extending between a trailing edge of the outer surface of the punch 7 and the leading edge of the front of the punch when the blank 13 is initially placed into the tooling.

In use, a blank is placed between the transfer arc grip 12 and external arc grip 11 at a trailing end and between the blank holder 8 and arc die 9 at a leading end. Depending upon the thickness, strength and size of the blank, the blank may require a pre-form rolling operation to produce a conical profile shaped to fit against the outer surface of the die 7 and to fit within the tooling. The initial rolling operation will provide a stiffer component that is easier to manipulate during the loading process. The blank shape is illustrated in FIG. 8A.

The external arc grip 11 is moved in an axial direction by suitable actuators to clamp the blank between the transfer arc grip 12 and external arc grip 11 and a sufficient force $F_G$ is applied to grip the blank without slippage, as shown in FIG. 8B. The optimal line of force action (i.e. movement) of the external arc grip is aligned with central axis 24 of the blank when initially placed within the tooling. However, the external arc grip 11 may be moveable in other directions, including parallel to the axis of the die or substantially perpendicular to said axis.

Next the arc die 9 is moved, by suitable actuators, towards the blank holder 8 to grip the blank therebetween. A force $F_{BH}$ is applied to sufficient to permit the blank to flow in a controlled manner from between the blank holder 8 and arc die 9 without tearing or wrinkling. Again, the optimum direction of movement of the arc die 9, and hence the application of force $F_{BH}$, is aligned with the central axis of the blank 24, as shown in FIG. 8C.

Next the blank holder 8 and arc die 9 and the internal arc grip 10 and external arc grip 11 are displaced in a first direction towards the central axis of the punch 7 in a substantially downwards direction as a complete assembly by a distance $D_V$ while maintaining the controlled force $F_{BH}$ between the blank holder 8 and arc die 9 and the clamping force $F_G$ between the internal arc grip 8 and external arc grip 11. During this stage the blank flows between the blank holder 8 and arc die 9, as shown in FIG. 8D. Again, as with the first embodiment it is envisaged that the blank holder 8 and arc die 9 may be held stationary and the punch 7 and associated components may be moved with respect to the blank holder 8.

Next the transfer and external arc grip 10,11 are held stationary and the blank holder 8 and arc die 9 are moved a further distance $D_d$ in said downwards direction, the blank flowing between the blank holder 8 and arc die 9, as shown in FIG. 8E, to create the shape shown in FIG. 9B.

Next the blank holder 8 and arc die are displaced horizontally by distance $D_H$ while maintaining a controlled force $F_{BH}$ between the blank holder 8 and the arc die 9. During this stage the blank flows between the blank holder 8 and arc die 9 while reverse drawing around the rear edge 18 of the arc die 9, as shown in FIG. 8F. The blank at this stage is shown in FIG. 9C.

Once the reverse draw is complete, the rear edge 18 of the arc die 9 comes into contact with the internal arc grip 10 to grip the blank therebetween without slippage and continued horizontal movement of the arc grip differentially drives the transfer and external arc grips 10,11 to perform a final stretching operation upon the blank. During such stage, the arc die 9 and internal arc grip 10 move through a distance $S_{OH}$ while the transfer arc grip 10 and external arc grip 11 move through a distance $S_{IH}$, as shown in FIG. 8G. The differential displacement mechanism ensures that a critical ratio of $S_{OH}$ to $S_{IH}$ is achieved to obtain the required final stretch without tearing or wrinkling of the blank.

Once full form has been achieved, the clamping force $F_{BH}$ is released to release the blank 13 and the arc die 9 and outer arc grip 11 are moved horizontally by a distance $D_{RH}$ to release the formed blank 13 from the tooling, as shown in FIG. 8H.

The present invention provides an improved single stage process and apparatus for forming a sector of a lip skin where the most important section of the lip skin from an aerodynamic point of view, namely the outer trailing edge is exposed to the minimum of stretching and bending and is free from clamping or tool marks. Because the part of the blank forming the outer trailing edge of the finished lip skin is largely unaffected by the forming process, the present invention can readily form laminar flow leading edges having a trailing edge whose axial length from the leading edge is of much greater length than that achievable with known forming methods.

The invention is not limited to the embodiments described herein but can be amended or modified without departing from the scope of the present invention.

The invention claimed is:

1. A method of forming a sector for a nacelle lip skin from a sheet metal blank comprising the steps of:

providing an arcuate or annular punch or mandrel having an inner surface, an outer surface and a leading edge, said punch substantially corresponding in shape to an inner surface of at least a sector of the nacelle lip skin;

placing the blank against the outer surface of the punch and clamping a trailing edge of the blank in a clamp to hold the blank against the outer surface of the punch, said clamp gripping said trailing edge of the blank without slippage;

gripping a leading edge of the blank, opposite said trailing edge, in a gripping device, at a location axially spaced from said punch adjacent and in front of the leading edge of the punch, said gripping device gripping said blank with sufficient force to permit the blank to flow therethrough in a controlled manner without tearing or wrinkling;

displacing the gripping device in a first direction, substantially radially with respect to the punch, towards the central axis of the punch while drawing the blank through the gripping device;

displacing the gripping device in a second direction, substantially axially with respect to the punch, towards and past the leading edge of the punch, to draw the blank over the leading edge of the punch while drawing the blank through the gripping device.

2. A method as claimed in claim 1, comprising the further step of further displacing the gripping device in said second direction while preventing the blank from being drawn through said gripping device to stretch the blank over the surface of the punch.

3. A method as claimed in claim 2, wherein said further step further comprises axially displacing said clamp relative to the punch in said second direction to further stretch the blank over the surface of the punch.

4. A method as claimed in claim 3, wherein the blank is prevented from being drawn through the gripping device by abutting a leading edge of the gripping device against a gripping member having an axial gripping face adapted to cooperate with a leading edge of the gripping device to clamp the blank therebetween.

5. A method as claimed in claim 1, wherein the gripping device comprises a blank holder having an arcuate and/or conical outer surface and a correspondingly shaped outer clamping member adapted to clamp the blank against the outer surface of the blank holder.

6. A method as claimed in claim 5, wherein said blank holder has a conical outer surface, said outer clamping member being moved in a direction substantially parallel to the central axis of the punch to clamp the blank between the blank holder and the clamping member.

7. A method as claimed in claim 1, wherein said clamp comprises substantially coaxial inner and outer clamping members, said inner and outer clamping members being radially moveable with respect to one another to clamp the blank between cooperating arcuate clamping surfaces thereof, said clamping surfaces having a curvature substantially corresponding to the curvature of the outer side of the punch.

8. A method as claimed in claim 1, wherein said clamp comprise substantially coaxial inner and outer clamping members having cooperating conical clamping surfaces, said method comprising moving the outer clamping member with respect to the inner member to clamp the blank between said cooperating clamping surfaces.

9. A method as claimed in claim 8, wherein said outer member and/or said inner member is moved towards the inner member in a direction substantially parallel to the central axis of the punch.

10. A method as claimed in claim 1, wherein said outer clamping member of the gripping device is provided with a radiused leading edge, the blank being drawn over said leading edge to reverse bend the blank as it flows through the gripping device.

11. A method as claimed in claim 10, wherein said leading edge of the outer clamping member abuts a further gripping member, to clamp the blank between said leading edge and said further portion during said further step of stretching the blank over the surface of the punch.

12. A method as claimed in claim 1, comprising an initial step of forming an initial curvature in said blank, substantially corresponding to the outer shape of the punch.

13. A method as claimed in claim 12, wherein said curvature is formed by clamping an initially flat blank in said clamp and said gripping device.

14. A method as claimed in claim 12, wherein said initial step comprises forming the blank to define at least a sector of a truncated cone.

15. A method as claimed in claim 14, wherein said clamp and said gripping device comprise surfaces adapted to engage said blank, said surfaces of said clamp and said gripping device having a conical profile.

* * * * *